US005686029A

United States Patent [19]

Middeldorf

[11] Patent Number: 5,686,029

[45] Date of Patent: Nov. 11, 1997

[54] PROCEDURE FOR MANUFACTURING FIREPROOF CRUCIBLES FOR STEEL-PROCESSING LADLES

[75] Inventor: Thomas Ferdinand Middeldorf, Bochum, Germany

[73] Assignee: Chemikalien-Gesellschaft Hans Lungmuss m.b.H., Dortmund, Germany

[21] Appl. No.: 564,077

[22] PCT Filed: Jun. 3, 1994

[86] PCT No.: PCT/EP94/01799

§ 371 Date: Dec. 8, 1995

§ 102(e) Date: Dec. 8, 1995

[87] PCT Pub. No.: WO94/29052

PCT Pub. Date: Dec. 22, 1994

[30] Foreign Application Priority Data

Jun. 11, 1993 [DE] Germany ..... 43 19 393.5

[51] Int. Cl.[6] ..... B22D 41/02

[52] U.S. Cl. ..... 264/30; 266/280; 266/286; 266/DIG. 1

[58] Field of Search ..... 266/44, 280, 281, 266/286, DIG. 1; 264/30

[56] References Cited

U.S. PATENT DOCUMENTS 3,944,193 3/1976 Imai et al. ..... 266/281

4,799,652 1/1989 Daussan et al. ..... 266/286

5,330,690 7/1994 Eitel ..... 264/30

5,511,762 4/1996 Connors, Jr. et al. ..... 264/30

*Primary Examiner*—Scott Kastler

*Attorney, Agent, or Firm*—Charles E. Baxley, Esq.

[57] ABSTRACT

The procedure for manufacturing fireproof crucibles for steel-processing ladles, in which aluminum deoxidation is carried out for the total quenching of liquid steel, is such that a monolithically hardening fireproof mass with a proportion of silicon dioxide is placed between the inside wall of the ladle and a reusable plug that is installed therein. After the plug has been removed, the ladle is put into use again, at which time a layer that contains alumina builds up on the hot side of the fireproof crucible and a highly sintered layer of greater hardness forms behind this. It is intended that a procedure such as this should simplify the reestablishment of the fireproof lining when the limits of use are reached, in view of the use of a layer that contains alumina and the highly sintered layer located behind this on the inside wall of the crucible. To this end, after a number of charges have been processed, a second crucible is installed as an expendable crucible within the first crucible, which now forms a safety crucible, this being done with the help of an appropriately smaller plug; when this reaches its limits of use it is broken out and the layer is reinstalled.

6 Claims, 1 Drawing Sheet

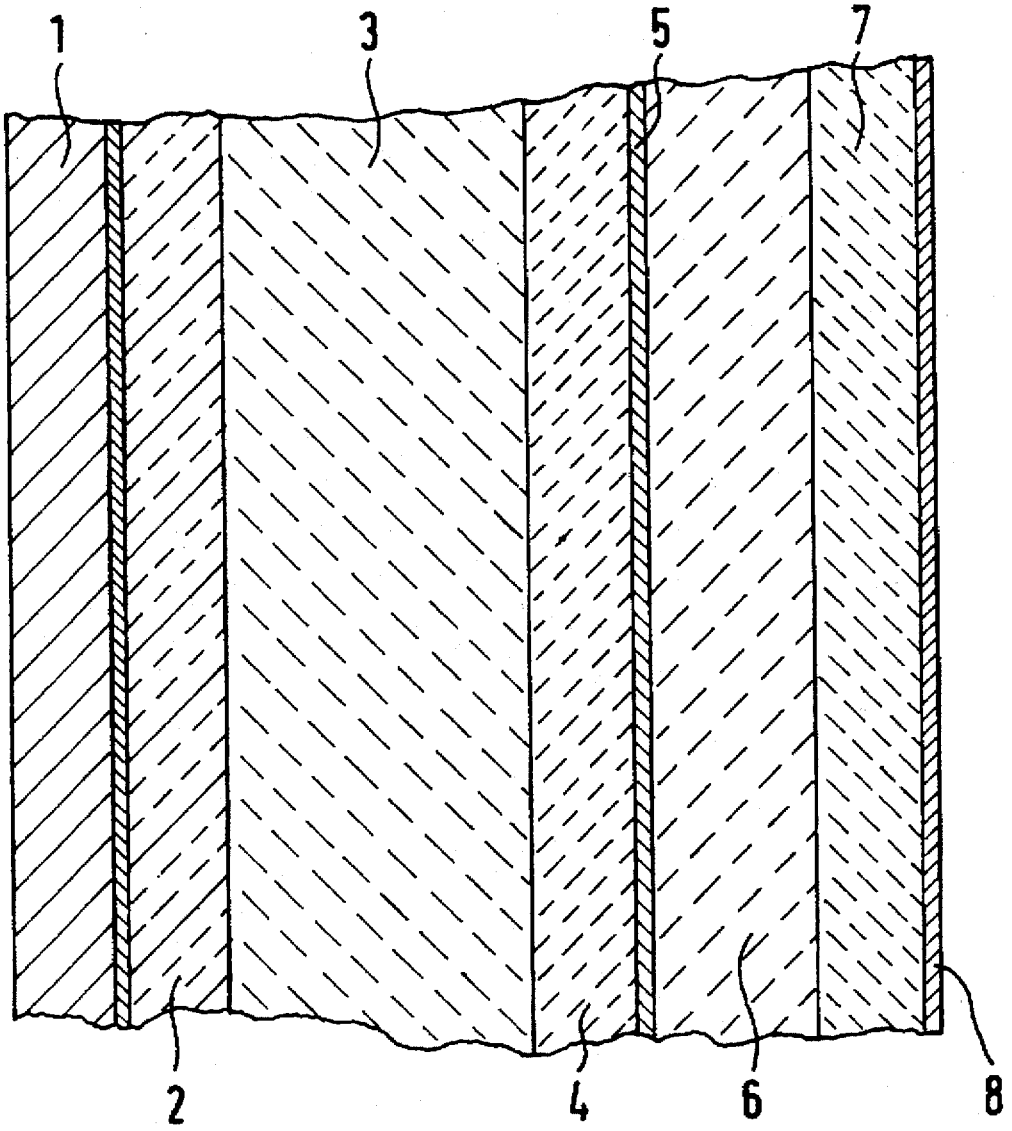
1
3
5
7
2
4
6
8

PROCEDURE FOR MANUFACTURING FIRE-PROOF CRUCIBLES FOR STEEL-PROCESSING LADLES

The present invention relates to a process for manufacturing fireproof crucibles for steel-processing ladles, in which aluminum deoxidation is carried out in order to quench liquid steel.

BACKGROUND OF THE INVENTION

Crucibles that are of fire-proof bauxite and which are produced according to such known procedures form a highly sintered surface layer on their hot side during operation; this surface layer is based on the metallurgical process of aluminum deoxidation that is used to produce completely killed steels, of the kind that are required, in particular, for continuous slab casting. The underlying chemical reaction is:

$$4Al_{met}+3\ SiO_{2\ solid}=2Al_2O_{3\ solid}+3Si_{met}$$

The metallic aluminum is present in the liquid steel, whereas the silicon dioxide originates from the fire-proof bauxite mass. The layer that contains the high alumina ($Al_2O_3$), which is referred to as "furring" in professional circles, and an extremely hard sintered layer that is located behind it, are formed on the hot side of the bauxite lining.

A disadvantage connected with crucibles that are manufactured and stressed in this way is the furring, Which increases with every charge and which leads to constantly diminishing capacity of the steel-processing ladle. If the lower limiting volume of the steel ladle is reached, all of the fire-proof crucible must be broken out, a task that is rendered extremely difficult because of the hardness of the sinter. For a considerable time, unsuccessful attempts have been made to remove the furring on the inner side of the crucibles by using pick-type tools; such attempts have been unsuccessful because when the sinter is broken off, the crucible becomes brittle, at least, and as a rule it disintegrates completely.

SUMMARY OF THE INVENTION

It is the task of the present invention to create a procedure of the type discussed above, that uses the formation of the high-alumina layer and the highly sintered layer that is located behind it on the inside of the crucibles to simplify the reestablishment of the fire-proof lining when the limit of use is reached.

This problem has been solved by a procedure of the type described, using the distinguishing features.

It is essential for the present invention that the furring on the outer safety crucible, with the highly sintered layer, makes it possible to break out the expendable crucible without becoming damaged itself. There is no sintering of the fire-proof material of the expendable crucible with that of the safety crucible, so that the sintered layer of the safety crucibles forms a boundary layer, and it is possible to work as far as this when breaking out the expendable crucible.

It is not necessary to determine the precise number of charges that have to be processed in order to form the safety crucible with sufficient furring. In some instances, it is necessary to keep track of the occurrence of the furring, in which case one can assume that 10 to 50 charges should be completed with the first crucible prior to the introduction of the expendable crucible.

It is a particular advantage if the ceramic of the expendable crucible and, accordingly, the fire-proof substance that is used for this, is such that, during operation, there is no complete sintering through the thickness of the wall of the expendable crucible. The expendable crucible adjacent to the furring of the outer safety crucible has a boundary layer that is of significantly less strength than the adjacent, sintered boundary layer of the safety crucible, which means that a subsequent scaling or breaking off of the inner expendable crucible is made easier and that damage to the safety crucible is all but precluded. Thus, the the reestablishment of the inner layer that forms the expendable crucible can be carried out several times until, for safety reasons, the first lining, which is to say the safety crucible, has to be broken out and replaced by a new one.

A fireproof substance that has an identical or similar raw materials base and an identical or similar binding system as that used for the safety crucible can be used for the expendable crucible so that aluminum deoxidation for the complete quenching of the liquid steel can be effected in the appropriate steel ladle. The useful limit is reached when the effective volume of the ladle falls below the prescribed minimum as a consequence of furring. However, it is also possible to use a basic fireproof substance that contains little or no silicon oxide for the expendable crucible. Such a basic expendable crucible of magnesium oxide or of a mixture of alumina and magnesium oxide or dolomite and magnesium oxide wears gradually. No furring forms on it because of its chemical composition, which contains very little silicon oxide. It is possible to wear out the basic expendable crucible either completely or else scale it or break it out after several charges, depending on operating conditions or according to the wear pattern, after which one can install a neutral expendable crucible in the safety crucible, as desired. It is advantageous that one adjusts the ceramic of the basic fireproof substance for the basic expendable crucible such that in the sintered state it is softer than the safety crucible, so as to ensure that the expendable crucible breaks out without any damage being done to the safety crucible.

BRIEF DESCRIPTION OF THE DRAWING

The present invention will be described below on the basis of the drawing appended hereto. The drawing is a diagramatic cross section through the wall of a steel-procedureing ladle with a fireproof lining.

DESCRIPTION OF THE PREFERRED EMBODIMENT

The steel-processing ladle has a steel outer casing 1, on the inside of which a permanent, insulating lining 2 is installed, optionally with an insulating mat interposed between them. Taken as a whole, this results in a highly effective insulating, permanent lining on the inside of the steel casing 1 of the ladle, and this serves to provide thermal installation.

First, a reusable steel plug (not shown in the drawing) is installed in the ladle in such a way as to leave a gap of approximately 8–12 cm between the plug and the permanent lining. The steel plug is the first steel plug that is needed, and it is of a greater diameter than the second steel plug that is used; this will be described in greater detail below.

A bauxite mass with a low cement content and an additional chemical binder with a conventional or exothermic binding system is inserted into the gap between the steel plug and the insulating and permanent lining 2. The following guide analysis applies to this, details being shown in percentages by weight:

$Al_2O_3$approx. 78–88%

$SiO_2$ approx. 4–88%

$TiO_2$ approx. 1–3%

$Fe_2O_3$approx. 1–1.5%

CaO approx. 0.5–1%

Remainder: Alkalis and other oxides

After this fireproof lining has bonded, it results in the outer fireproof crucible of the steel ladle that subsequently forms the safety crucible.

As soon as the first fireproof lining has bonded sufficiently, the reusable first steel plug is withdrawn from the ladle. The first crucible is then dried and heated; to this end, the steel ladle is placed in the steel plant and 10 to 50 charges of alumina deoxydized steel are processed in it.

The first crucible is now sintered, and has very thin furring that adheres firmly to the inner surface of the crucible. Immediately beneath this there is a layer of mass that is approximately 0.1 to 5 cm thick and this is more strongly sintered and is harder. Deeper within the fireproof material, closer to the steel casing 1, there is almost completely unmodified bauxite lining 3 without any infiltration, and a highly sintered layer 4 that is of greater hardness is located on this and this layer 4 is covered to the outside by an alumina furring 5 that consists of the products of the aluminum deoxidation.

After the ladle has cooled down, a second reusable steel plug that is of appropriately smaller diameter compared to the previously used plug is so inserted into the safety crucible 3–5 that has been formed by the first crucible that a gap of suitable size is left between the surface of the plug and the alumina furring 5. In practice, a gap of 5–6 cm or more is left; the gap should be no smaller than 4 cm.

Once again, a fireproof mass is inserted into this gap in order to form a so-called working lining, which can also be referred to as a working crucible or expendable crucible. After this working lining-has bonded, the second reusable steel plug is withdrawn from the ladle and the working lining is dried and then heated. Subsequently, the ladle is once again returned to the steel works where, after sintering, one obtains an expendable crucible that again has a layer 6 that is of an almost original largely unsintered fireproof material, a highly sintered layer 7 that is of greater hardness, and aluminum furring 8 that is formed from the products of the aluminum deoxidation. Up to one hundred charges or more can be processed with this expendable crucible 6–8, and when the useful limit is reached, the expendable crucible is broken out. When this is done, it is easy to orientate oneself with the hard sintered layer 4 of the safety crucible that is covered with the alumina furring 5, in front of which there is a relatively soft layer 6 that is thus easy to break out and which is of almost original fire proof material. Thus, the relatively soft layer 6 forms a nominal break point when separating out the worn-out expendable crucible.

The expendable crucible 6–8 that is shown in the drawing consists of a fireproof mass with an identical or similar raw materials base as well an identical or similar binding system, as in the safety crucible 3–5. In principle, in place of an expendable crucible of this kind, it is also possible to use a basic expendable crucible that does not form furring because of its chemical composition that contains little silicon oxide. Such an expendable crucible wears gradually, in which connection here, once again, the hard sintered layers 4 and 5 of the safety crucible simplify removal of the rest of the expendable crucible. For the remainder, it is also possible to break out the basic expendable crucible even before it reaches its wear limit, if the steel ladle is to be provided with a new fireproof lining to form another, e.g., neutral, expendable crucible for other purposes.

I claim:

1. A process for manufacturing fireproof crucibles for steel-processing ladles, in which aluminum deoxidation is carried out for total quenching of liquid steel, in which a monolithically hardened fireproof mass that contains alumina with a proportion of silicon dioxide is inserted between an inside wall of the ladle and a reusable steel plug is installed therein forming a fireproof first crucible, the ladle being used after removal of the plug, at which time a layer that contains alumina forms on a hot inner side of the fireproof first crucible, a highly sintered surface layer of greater hardness forming thereon, wherein after a number of charges, using an appropriately smaller plug, a second expendable crucible is formed inward of the fireproof first crucible whereby the second expendable crucible can be broken out on reaching its limit of use, and a replacement second expendable crucible can then be reinstalled.

2. The process as claimed in claim 1, wherein from one to fifty charges are processed with the fireproof first crucible, before the installation of the second expendable crucible.

3. The process as claimed in claim 2, wherein ceramic of the second expendable crucible is such that no complete sintering takes place through the thickness of its walls during operation.

4. The process as claimed in any one of the claims 1 to 3, wherein a fireproof mass with substantially same raw materials base as well as substantially same manufacturing steps as those of the first reusable crucible is used for the second expendable crucible.

5. The process as claimed in any one of the claims 1–3, wherein a basic fireproof mass that contains little or no silicon dioxide is used for the second expendable crucible.

6. The process as claimed in claim 5, wherein ceramic of the basic fireproof mass is such that when it is in the sintered state it is softer than the first reusable crucible.

* * * * *